US009802305B2

(12) United States Patent
Diem et al.

(10) Patent No.: US 9,802,305 B2
(45) Date of Patent: Oct. 31, 2017

(54) HAND-HELD POWER TOOL DEVICE

(71) Applicant: Robert Bosch GmbH, Stuttgart (DE)

(72) Inventors: Carsten Diem, Ludwigsburg (DE); Hagen Philipp Keinath, Stuttgart (DE); Matthias Tauber, Bad Boll (DE)

(73) Assignee: Robert Bosch GmbH, Stuttgart (DE)

( * ) Notice: Subject to any disclaimer, the term of this patent is extended or adjusted under 35 U.S.C. 154(b) by 490 days.

(21) Appl. No.: 14/315,084

(22) Filed: Jun. 25, 2014

(65) Prior Publication Data

US 2015/0000943 A1 Jan. 1, 2015

(30) Foreign Application Priority Data

Jun. 28, 2013 (DE) ..... 10 2013 212 626

(51) Int. Cl.
*B25D 16/00* (2006.01)

(52) U.S. Cl.
CPC ..... *B25D 16/00* (2013.01); *B25D 2216/0069* (2013.01); *B25D 2250/221* (2013.01)

(58) Field of Classification Search
CPC .... B23Q 5/033; B25D 11/005; B25D 16/006; B25D 11/125; B25D 17/00; G06F 8/65; H04L 63/10
USPC ..... 173/11
See application file for complete search history.

(56) References Cited

U.S. PATENT DOCUMENTS 4,471,533 A * 9/1984 Van Steenwyk ..... E21B 47/022 33/302
4,996,878 A * 3/1991 Kubler ..... G01P 15/123 73/510
5,914,882 A * 6/1999 Yeghiazarians ..... F16P 3/00 408/1 R
6,044,918 A * 4/2000 Noser ..... B25D 16/00 173/176
6,111,515 A * 8/2000 Schaer ..... B25F 5/00 340/679
7,036,703 B2 * 5/2006 Grazioli ..... B25B 27/0085 173/176
2004/0226728 A1 * 11/2004 Boeni ..... B25D 11/005 173/2
2006/0289183 A1 * 12/2006 Schreiber ..... B25F 5/006 173/162.2
2009/0200053 A1 * 8/2009 Scrimshaw ..... B23B 31/123 173/47
2012/0279741 A1 * 11/2012 Schlesak ..... B25D 11/125 173/162.2

(Continued)

*Primary Examiner* — Nathaniel Chukwurah
(74) *Attorney, Agent, or Firm* — Maginot, Moore & Beck LLP

(57) ABSTRACT

A hand-held power tool device comprises an impact tool unit, an impact detection unit, and a blocking detection unit. The impact tool unit is configured to drive an insertion tool at least partially in at least one of a rotational fashion and a translatory fashion. The impact detection unit is configured to detect at least one impact parameter, such as linear acceleration running at least substantially parallel to a processing axis of the insertion tool. The blocking detection unit is configured to detect at least one blocking parameter, such as at least one an angular acceleration about the processing axis of the insertion tool. The impact detection unit and the blocking detection unit are formed at least partially as one-piece.

8 Claims, 2 Drawing Sheets

(56) References Cited

U.S. PATENT DOCUMENTS

2012/0297878 A1* 11/2012 Neul ..... G01P 15/0922
73/514.29
2012/0312570 A1* 12/2012 Wanek ..... B25B 21/00
173/1

* cited by examiner

HAND-HELD POWER TOOL DEVICE

This application claims priority under 35 U.S.C. §119 to patent application no. DE 10 2013 212 626.3, filed on Jun. 28, 2013 in Germany, the disclosure of which is incorporated herein by reference in its entirety.

BACKGROUND

A hand-held power tool device having an impact tool unit which is designed to be able to drive an insertion tool in particular at least partially in a rotational and/or translatory fashion is known.

SUMMARY

The disclosure is based on a hand-held power tool device having an impact tool unit, which is designed to be able to drive an insertion tool in particular at least partially in a rotational and/or translatory fashion, having an impact detection unit which is provided at least partially to detect at least one impact parameter, in particular a linear acceleration, which runs in particular at least substantially parallel to a processing axis of the insertion tool, and having a blocking detection unit which is provided at least partially to detect at least one blocking parameter, in particular an angular acceleration, in particular about a processing axis of the insertion tool.

It is proposed that the impact detection unit and the blocking detection unit are designed at least partially in one piece. An "impact tool unit" is to be understood in this context as being, in particular, a unit which is provided at least partially for producing a pulse, in particular on an insertion tool of a hand-held power tool, in particular by converting a rotational movement of a drive unit of the hand-held power tool into a linear movement, and/or for driving the insertion tool in rotation in an operating state. The impact tool unit comprises in particular at least one piston element which is preferably at least partially mechanically connected to a drive unit which preferably comprises the hand-held power tool. The piston element is preferably provided for carrying out a linear movement in an operating state. The guide element is preferably formed by a hammer tube and is additionally preferably provided for guiding the piston element linearly. In one particularly preferred embodiment, the impact tool unit comprises a pneumatic impact tool.

"Drive in a rotational fashion" is to be understood in this context as meaning, in particular, transmission and/or generation of an in particular at least virtually uniform rotating movement whose movement path is arranged at least approximately in a circular fashion about a rotational axis, in particular about the processing axis of the insertion tool. "Drive in a translatory fashion" is to be understood in this context as meaning, in particular, transmission and/or generation of an in particular at least virtually uniform linear movement whose movement path is arranged at least approximately in a linear fashion and at least substantially parallel to a rotational axis, in particular to the processing axis of the insertion tool, wherein the movement is embodied in a preferably oscillating fashion.

"At least substantially parallel" is to be understood in this context as meaning in particular that a direction of the linear acceleration and the processing axis of the insertion tool enclose an angle which is in particular less than 15°, preferably less than 10°, preferably less than 5° and particularly preferably less than 1°. "In one piece" is to be understood as meaning in particular at least connected in a materially joined fashion, for example by a welding process, a bonding process, a spraying process and/or one other process which appears appropriate to a person skilled in the art and/or advantageously formed in one piece, for example by manufacturing from a casting material and/or by manufacturing in a single-component or multi-component injection molding method and advantageously from a single blank. The fact that two units are designed "partially in one piece" is to be understood as meaning in particular that the units have at least one common element which is a component, in particular a functionally important component, of both units.

As a result, an advantageously compact, preferably cost-effective embodiment of the inventive hand-held power tool device which provides savings in terms of components and installation space can be obtained.

In addition, it is proposed that the hand-held power tool device comprises at least one sensor element which is provided at least to detect the angular acceleration about a processing axis of the insertion tool and the linear acceleration which runs at least substantially parallel to the processing axis of the insertion tool. A "sensor element" is to be understood in this context as meaning in particular an element which is provided at least partially to convert at least one parameter, which comprises in particular the angular acceleration and/or the linear acceleration and which in particular describes and/or comprises at least one chemical and/or preferably at least one physical property, into an analogue, binary and/or preferably digital electrical signal and to make the electrical signal available, in particular to an open-loop and/or closed-loop control unit. The sensor element can preferably comprise at least one strain gauge, at least one sensor of a micro-electro-mechanical system (MEMS), in particular at least one gyro sensor, at least one piezo-ceramic sensor chip and/or at least one other embodiment of a sensor which appears appropriate to a person skilled in the art. As a result, preferably precise open-loop and/or closed-loop control of the hand-held power tool device can be achieved.

Furthermore, it is proposed that the at least one sensor element of the sensor unit is formed at least partially from an acceleration sensor. An "acceleration sensor" is to be understood in this context as meaning in particular a sensor element which is provided at least partially to measure at least one acceleration in at least one direction, in that in particular an inertial force which acts on a test mass is determined or detected. As a result, for example an increase or decrease in speed can be determined. The acceleration sensor belongs in particular to the group of inertial sensors. Alternatively or additionally, at least one temperature sensor, at least one rotational speed sensor, at least one torque sensor, at least one pressure sensor, at least one speed sensor, at least one virtual sensor and/or at least one other sensor element which appears appropriate to a person skilled in the art is also conceivable. As a result, an advantageously simple and cost-effective embodiment of the sensor element of the hand-held power tool device can be achieved.

In addition, it is proposed that the at least one sensor element of the sensor unit is formed at least partially from a three-axis acceleration sensor. A "three-axis acceleration sensor" is to be understood in this context as meaning in particular a sensor element which is formed from a movement sensor and which has three measuring axes which each characterize a detectable acceleration direction. The three measuring axes are preferably each arranged perpendicular with respect to one another, wherein in each case one of the three measuring axes forms an x axis, a y axis and a z axis, as a result of which a coordinate system is therefore created. As a result, spatial detection of at least one operating parameter and/or ambient parameter can constructively easily be achieved.

In addition, it is proposed that the at least one sensor element is provided at least partially to detect a spatial position of the impact tool unit. A "spatial position of the impact tool unit" is to be understood in this context as meaning in particular an orientation of the processing axis, which is in particular spatial and considered in a three-dimensional fashion, of the insertion tool in particular relative to the fixed direction of action of the weight. As a result, preferably precise open-loop and/or closed-loop control of the hand-held power tool device can be achieved.

Furthermore, it is proposed that the hand-held power tool device comprises at least one open-loop and/or closed-loop control unit which is provided at least partially for performing open-loop and/or closed-loop control of the impact tool unit, at least partially as a function of the spatial position. "Open-loop and/or closed-loop control" is to be understood in this context as meaning in particular a process which is independent at least partially of an operating state of the drive unit and/or of the impact tool unit, in particular at least partially decoupled from a rotational speed of the drive unit and which is provided at least partially to at least partially actively influence operation of at least the impact tool unit and/or adapt and/or approximate the operation of the impact tool unit at least partially to a predefined sequence and/or to change in particular dynamically variable operating parameters of the impact tool unit, preferably in accordance with an algorithm, in particular actively. The open-loop and/or closed-loop control unit can be designed in particular at least partially mechanically, particularly preferably at least partially electronically. The open-loop and/or closed-loop control unit preferably additionally comprises a computing unit and in particular in addition to the computing unit a memory unit with an open-loop and/or closed-loop control program which is stored therein and which is provided to be carried out by the computing unit. In one particularly preferred exemplary embodiment, the open-loop and/or closed-loop control unit comprises at least one microcontroller. The open-loop and/or closed-loop control unit preferably forms at least partially an electronic unit of the hand-held power tool which comprises the hand-held power tool device. "Electronic unit" is to be understood in this context as meaning in particular a unit which is provided, at least in one operating state of the hand-held power tool, for at least partially performing open-loop and/or closed-loop control, in particular of the drive unit of the hand-held power tool. The electronic unit preferably comprises at least one engine controller of the drive unit. The electronic unit preferably comprises electronic components such as in particular at least one transistor, at least one capacitor, at least one processor, particularly preferably at least one field effect transistor (MOSFET) and/or at least one bipolar transistor, in particular with an insulated gate electrode (IGBT). As a result, preferably precise open-loop and/or closed-loop control, adapted to an application, of at least the impact tool unit of the hand-held power tool device can be achieved.

In addition, a hand-held power tool having a hand-held power tool device according to the disclosure is proposed.

In addition, an impact detection unit of the hand-held power tool device according to the disclosure is proposed.

In addition, a blocking detection unit of the hand-held power tool device according to the disclosure is proposed.

The hand-held power tool device according to the disclosure is not restricted here to the application and embodiment described above. In particular, the hand-held power tool device according to the disclosure can have, for the purpose of carrying out a method of functioning described herein, a number of individual elements, components and units which differs from the number thereof mentioned herein.

BRIEF DESCRIPTION OF THE DRAWINGS

Further advantages can be found in the following description of the drawing. An exemplary embodiment of the disclosure is illustrated in the drawing. The drawing, the description and the claims contain numerous features in combination. The person skilled in the art will also expediently consider the features individually and combine them to form further appropriate combinations.

In the drawing.

DETAILED DESCRIPTION

Figure 1:
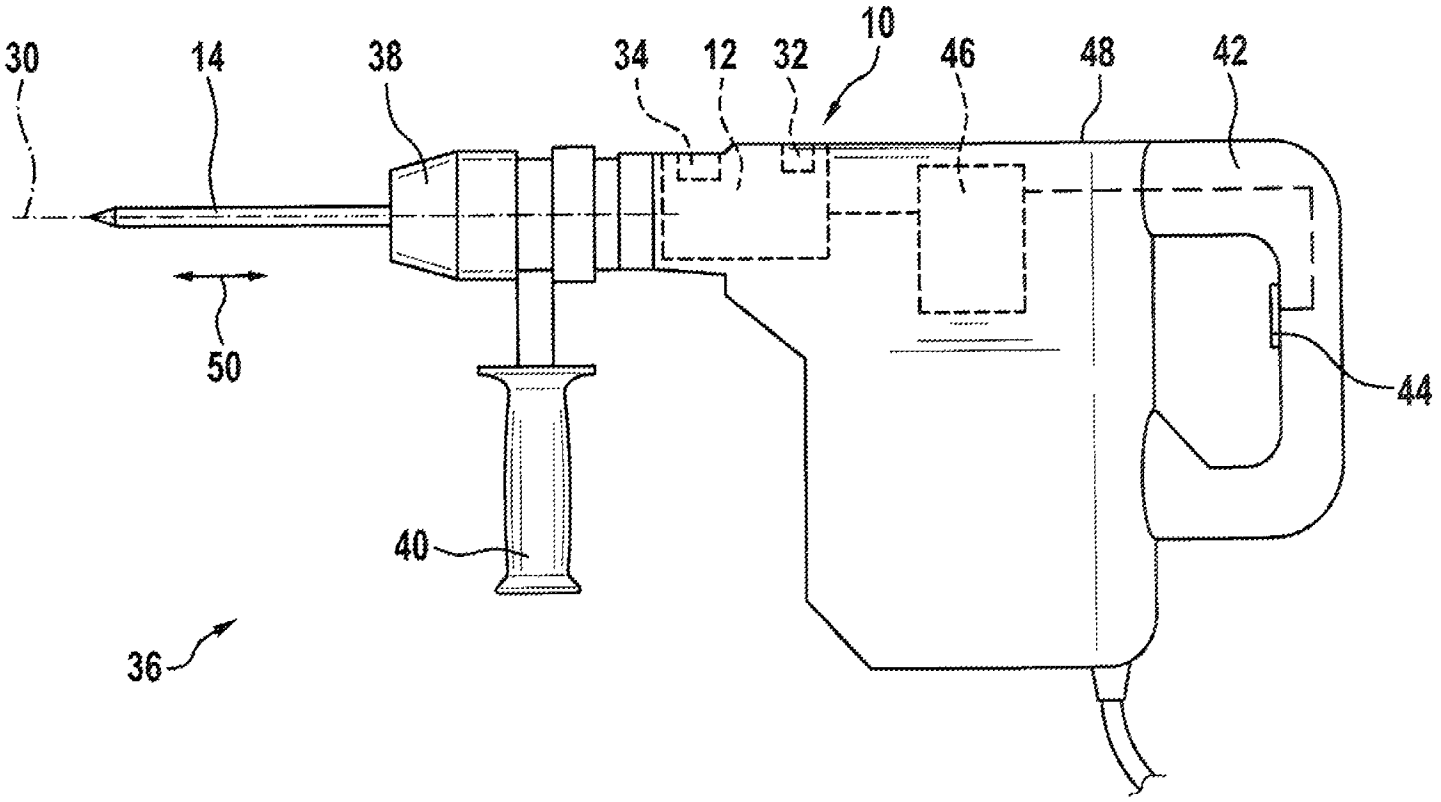
FIG. 1 shows a hand-held power tool with a hand-held power tool device according to the disclosure in a schematic side view.

FIG. 1 illustrates a hand-held power tool 36, formed by a drill hammer, with a hand-held power tool device 10. However, other embodiments of the hand-held power tool 36 which appear appropriate to a person skilled in the art, for example as a percussion drilling machine, as a chipping hammer or as a demolition hammer, are also conceivable. The hand-held power tool 36 is formed by an electric hand-held power tool. In a front region of the hand-held power tool 36 a tool receptacle 38 is arranged which is provided to receive an insertion tool 14, in particular a drilling or chipping insertion tool. Furthermore, an additional handle 40 is arranged in the front region of the hand-held power tool 36, and a main handle 42 is arranged on a side of the hand-held power tool 36 facing away from the front region, by means of which additional handle 40 and main handle 42 the hand-held power tool 36 can be guided by an operator. The main handle 42 is embodied in a U shape. A switching element 44, which can be activated by an operator and is provided for activating a drive unit 46, is arranged on the main handle 42. The additional handle 40 is embodied in a rod shape. A housing 48 of the hand-held power tool 36 encloses the drive unit 46 (not illustrated in more detail) which is formed by an electric motor and can be activated by means of the switching element 44, and the hand-held power tool device 10. The drive unit 46 is provided for driving an impact tool unit 12 of the hand-held power tool device 10 of the hand-held power tool 36.

The hand-held power tool device 10 comprises the impact tool unit 12. The impact tool unit 12 is provided to drive in a rotational and/or translatory fashion the insertion tool 14 which is held in the tool receptacle 38 of the hand-held power tool 36. The impact tool unit 12 is provided to drive the insertion tool 14 in a translatory fashion in a hammer operating state, in a rotational and a translatory fashion in an impact drill operating state and in a rotational fashion in a drill operating state. The impact tool unit 12 is provided to drive the insertion tool 14 in a rotational and/or impacting fashion. The impact tool unit 12 (not illustrated in more detail) comprises a transmission element which is formed by a dolly and is provided to transmit a pulse to the insertion tool 14 in the hammer operating state and in the impact drill operating state. The impact tool unit 12 additionally has a guide element which is provided, in an operating state of the impact tool unit 12, to guide the at least one transmission element. The guide element is formed by a hammer tube. The guide element is provided for linearly guiding a transmission element, a beater element and a piston element parallel to a processing axis 30 of the insertion tool 14, which forms an axial direction 50 of the impact tool unit 12. A piston element which is driven by the drive unit 46 is guided in the axial direction 15 of the guide element. The beater element is arranged in the axial direction 50 behind the piston element when considered from the drive unit 46 toward the tool receptacle 38. The beater element is also mounted so as to be movable in the axial direction 50 in the guide element.

Figure 2:
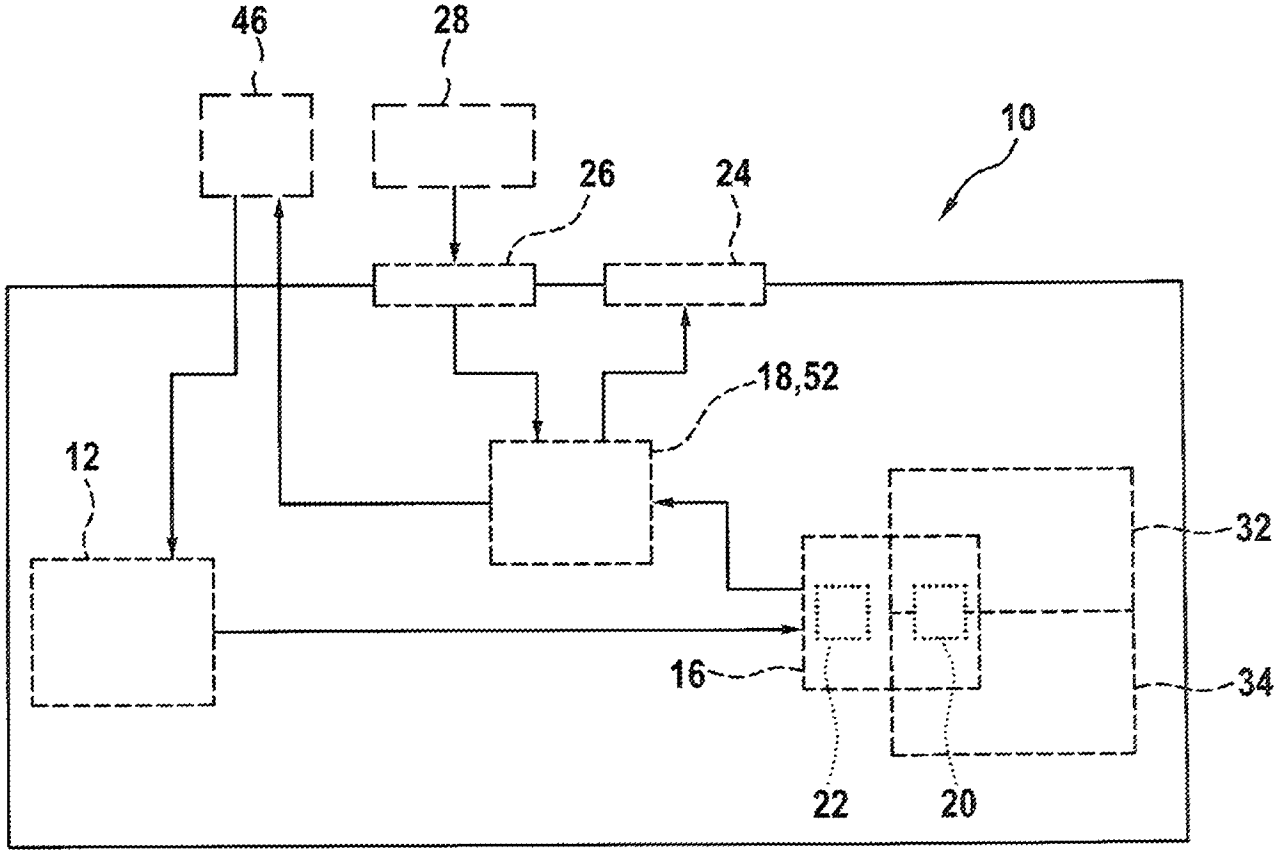
FIG. 2 shows the hand-held power tool device according to the disclosure in a schematic illustration.

FIG. 2 is a schematic illustration of the hand-held power tool device 10. The hand-held power tool device 10 has a sensor unit 16 which is provided to detect at least one operating parameter and/or ambient parameter of the hand-held power tool device 10. The sensor unit 16 is provided to detect one or more operating parameters of the impact tool unit 12. In addition, the sensor unit 16 is provided to detect one or more ambient parameters of the impact tool unit 12. The sensor unit 16 is provided to detect angular acceleration about the processing axis 30 of the insertion tool 14 and linear acceleration parallel to the processing axis 30 of the insertion tool 14.

The sensor unit 16 comprises at least a first sensor element 20 which is provided to detect the at least one operating parameter and/or ambient parameter of the hand-held power tool device 10. The first sensor element 20 is provided to detect a spatial position of the impact tool unit 12 of the hand-held power tool device 10. The first sensor element 20 is provided to detect the spatial position of the processing axis 30 of the insertion tool 14 relative to the direction of action of the weight of the hand-held power tool device 10. The first sensor element 20 is provided to detect an operating state of the impact tool unit 12. The first sensor element 20 is provided to detect the angular acceleration about the processing axis 30 of the insertion tool 14. The first sensor element 20 is provided to detect the linear acceleration parallel to the processing axis 30 of the insertion tool 14. The first sensor element 20 is formed by an acceleration sensor. The first sensor element 20 is formed by a three-axis acceleration sensor. However, it is also conceivable for the first sensor element 20 to be formed by a MEMS sensor. Alternatively or additionally, the sensor unit 16 for detecting the angular acceleration can also comprise at least one rotational rate sensor.

The sensor unit 16 comprises at least one further sensor element 22 which is provided to detect at least one further operating and/or ambient parameter of the hand-held power tool device 10. The further sensor element 22 of the sensor unit 16 is provided to detect an ambient parameter of the impact tool unit 12. The further sensor element 22 of the sensor unit 16 is provided to detect the ambient air pressure of the impact tool unit 12. The further sensor element 22 of the sensor unit 16 is formed by a pressure sensor.

The hand-held power tool device 10 comprises the impact tool unit 12, an impact detection unit 32 which is provided to detect a translatory drive state of the insertion tool 14 by the impact tool unit 12, and a blocking detection unit 34 which is provided to detect angular acceleration of the hand-held power tool 36 about the processing axis 30 of the insertion tool 14 or of the impact tool unit 12. The impact detection unit 32 is provided to detect linear acceleration which runs parallel to a processing axis 30 of the insertion tool 14. The impact detection unit 32 comprises a sensor element 20 which is provided to detect the translatory drive state of the insertion tool 14. The sensor element 20 is provided to detect the linear acceleration in the axial direction 50 in the hammer operating state and in the impact drill operating state. The blocking detection unit 34 forms an antirotation system. The blocking detection unit 34 comprises a sensor element 20 which is provided to detect the angular acceleration. The impact detection unit 32 and the blocking detection unit 34 of the hand-held power tool device 10 are designed at least partially in one piece. The impact detection unit 32 and the blocking detection unit 34 are designed at least partially in one piece with the sensor unit 16. The impact detection unit 32 comprises the first sensor element 20 of the sensor unit 16. The blocking detection unit 34 also comprises the first sensor element 20 of the sensor unit 16.

The hand-held power tool device 10 also has an open-loop and/or closed-loop control unit 18 which is provided for performing open-loop and/or closed-loop control of the impact tool unit 12 as a function of the operating and/or ambient parameters, which is sensed by the sensor unit 16. The open-loop and/or closed-loop control unit 18 is provided for performing open-loop and/or closed-loop control of the impact tool unit 12 as a function of the spatial position of the impact tool unit 12, the linear acceleration and/or the angular acceleration. The open-loop and/or closed-loop control unit 18 is embodied as a control unit 52 and provided for controlling the impact tool unit 12 via the drive unit 46. Alternatively or additionally, it is also conceivable for the open-loop and/or closed-loop control unit 18 to be embodied as a closed-loop control unit and to be provided for performing closed-loop control of the impact tool unit 12. The control unit 52 is provided for performing open-loop control of the impact control unit 12 as a function of the operating parameters which are detected by the first sensor element 20 of the sensor unit 16. The control unit 52 is additionally provided for performing open-loop control of the impact tool unit 12 as a function of the ambient parameter which is detected by the further sensor element 22 of the sensor unit 16. Alternatively or additionally, it is also conceivable for the control unit 52 to be provided for performing manual open-loop control, for example by means of an adjustment knob or adjustment wheel which can be activated by an operator.

The control unit 52 comprises a microcontroller. The control unit 52 is coupled electronically to the sensor unit 16. The parameters which are detected by the sensor elements 20, 22 of the sensor unit 16 are passed on to the control unit 52.

The control unit 52 evaluates the parameters which are detected by the sensor unit 16, compares the parameters which are detected by the sensor unit 16 with predefined limiting values which are stored in the control unit 52 and controls the impact tool unit 12 in accordance with a control algorithm which is stored in the control unit 52. If the detected parameters reach or exceed a predefined maximum value and/or if the detected parameters reach or undershoot a predefined minimum value, the control unit 52 changes an output control parameter which is passed on to the drive unit 46 or to the impact tool unit 12.

The weight which acts on the movably mounted components of the impact tool unit 12 affects the operation of the impact tool unit 12. In the spatial position in which the processing axis 30 of the insertion tool 14 is arranged parallel to the direction of action of the weight and a transmission direction of the pulse from the dolly element to the insertion tool 14 in the hammer operating state or in the impact drill operating state is arranged opposed to the direction of action of the weight, the movable components of the impact tool unit 12 must be accelerated counter to the weight. In contrast, in the spatial position in which the processing axis 30 of the insertion tool 14 is arranged parallel to the direction of action of the weight and the direction of transmission of the pulse from the dolly element to the insertion tool 14 is arranged in the same direction as the direction of action of the weight in the hammer operating state or in the impact drill operating state, the movable components of the impact tool unit 12 are additionally accelerated by the weight. In the spatial position in which the processing axis 30 of the insertion tool 14 is arranged perpendicularly with respect to the direction of action of the weight, the weight influences the movable components of the impact tool unit 12 only comparatively insignificantly. The intermediate spatial positions in which the processing axis 30 of the insertion tool 14 and the direction of action of the weight enclose an angle which is between 0° and 90°, the output control parameters have to be correspondingly adapted by the control unit 52. The output control parameters are formed by a rotational speed or a torque of the drive unit 46 or by other parameters which appear appropriate to a person skilled in the art. As a result, an optimum processing result can be achieved in each spatial position.

The control unit 52 is also provided to switch off the drive unit 46 and therefore the impact tool unit 12 in the impact drill operating state or in the drill operating state if the angular acceleration which is detected by the blocking detection unit 34 or by the first sensor element 20 of the sensor unit 16 reaches or exceeds a predefined maximum value. A high angular acceleration about the processing axis 30 of the insertion tool 14 in the impact drill operating state or in the drill operating state can characterize an uncontrolled case of blocking in which the insertion tool 14 is blocked and the rotational movement is transmitted to the hand-held power tool 36. As a result of the drive unit 46 and therefore the impact tool unit 12 being switched off in this uncontrolled case of blocking, an advantageously high level of operational reliability can be achieved. The first sensor element 20, which is formed by the three-axis acceleration sensor, detects the angular acceleration via two of the total three measuring axes. The three measuring axes of the three-axis acceleration sensor are each arranged perpendicularly with respect to one another. The two measuring axes of the three-axis acceleration sensor, which are provided to detect the angular acceleration about the processing axis 30 of the insertion tool 14, are arranged perpendicularly with respect to the processing axis 30 of the insertion tool 14.

The impact detection unit 32, or the first sensor element 20 of the sensor unit 16 which is formed by the three-axis acceleration sensor, detects the linear acceleration by means of the measuring axis of the three-axis acceleration sensor which is arranged parallel to the processing axis 30 of the insertion tool 14 and perpendicularly with respect to the two other measuring axes of the three-axis acceleration sensor which are provided to detect the angular acceleration about the processing axis 30 of the insertion tool 14. The three-axis acceleration sensor detects the spatial position with all three measuring axes.

The hand-held power tool device 10 additionally has an output unit 24 which is provided to output the at least one operating and/or ambient parameter in a way which can be perceived by the operator of the hand-held power tool 36. The output unit 24 is electronically coupled to the control unit 52 and therefore also to the sensor unit 16. The output unit 24 is provided for outputting the spatial position which is detected by the first sensor element 20 of the sensor unit 16. The output unit 24 is provided for visually outputting the detected spatial position. Alternatively or additionally, an acoustic, a haptic and/or another output which appears appropriate to a person skilled in the art are/is also conceivable. In addition, it is also conceivable for the output unit 24 to be provided to output the detected angular acceleration, the detected linear acceleration and/or another parameter which appears appropriate to a person skilled in the art. The output unit 24 comprises a display. However, it is also conceivable for the output unit 24 to alternatively or additionally comprise individually arranged LEDs, a loudspeaker or other output elements which appear appropriate to a person skilled in the art. The output unit 24 is let into the housing 48 of the hand-held power tool 36. The output unit 24 can be provided to support an operator by means of the outputting of the current spatial position in a selected orientation of the hand-held power tool 36 such as, for example, in a horizontal or in a perpendicular position. For example, arrows which indicate to an operator the direction he must rotate or tilt the hand-held power tool 36 in order to reach the horizontal or the perpendicular position of the processing axis 30 of the insertion tool 14 or another position which appears appropriate to a person skilled in the art can be displayed on the display of the output unit 24. As a result, a perpendicular and/or horizontal drilling function can be achieved by means of the sensor unit 16, the control unit 52 and the output unit 24.

The hand-held power tool device 10 also has an interface unit 26 which is provided to exchange an operating and/or ambient parameter data set with an external information unit 28. The external information unit 28 can be coupled to the hand-held power tool device 10 of the hand-held power tool 36 via the interface unit 26. In the state in which the hand-held power tool device 10 of the hand-held power tool 36 is coupled to the external information unit 28, the operating and/or ambient parameter data set which comprises, for example, information on the surroundings of the hand-held power tool 36 which has the hand-held power tool device 10 can be transferred from the external information unit 28 to the control unit 52 of the hand-held power tool device 10. The external information unit 28 is formed by a smartphone. However, other embodiments of the external information unit 28 which appear appropriate to a person skilled in the art are also conceivable. The external information unit 28 is connected to the hand-held power tool device 10 of the hand-held power tool 36 via a cable (not illustrated), in particular via a data cable. The interface unit 26 has a plug element (not illustrated in more detail), in particular a USB slot which is let into the housing 48 of the hand-held power tool 36. However, it is also conceivable for the external information unit 28 to be connected to the hand-held power tool device 10 of the hand-held power tool 36, in particular in a contactless fashion, by means of a radio signal such as, for example, Bluetooth, WLAN, IR or another technology which appears appropriate to a person skilled in the art. An operator can, for example, hold its smartphone, which forms the external information unit 28, against an inclined wall face such as, for example, a slope of a roof which is to be processed with the hand-held power tool 36, in order thereby to detect an inclination of the wall face. For this purpose, the external information unit 28 can have an app or another program. The detected inclination of the wall face which is to be processed can be passed on subsequently or simultaneously via the interface unit 26 to the hand-held power tool device 10 of the hand-held power tool 36 where the control unit 52 adapts its output control parameters, in particular for the perpendicular and/or horizontal drilling function, to this detected inclination of the wall face to be processed.

What is claimed is:

1. A hand-held power tool device, comprising:

an insertion tool;

an impact tool unit configured to drive the insertion tool at least partially in at least one of a rotational fashion and a translatory fashion;

an impact detection unit configured to detect at least one impact parameter, wherein the at least one impact parameter is a linear acceleration running at least substantially parallel to a processing axis of the insertion tool with respect to a housing of the hand-held power tool device;

a blocking detection unit configured to detect at least one blocking parameter, wherein the at least one blocking parameter is an angular acceleration about the processing axis of the insertion tool with respect to the housing of the hand-held power tool device; and a sensor element configured to detect both the linear acceleration and the angular acceleration.

2. The hand-held power tool device according to claim 1, wherein the sensor element is an acceleration sensor.

3. The hand-held power tool device according to claim 2, wherein the sensor element is at a three-axis acceleration sensor.

4. The hand-held power tool device according to claim 1, wherein the sensor element is configured to detect a spatial position of the impact tool unit.

5. The hand-held power tool device according to claim 4, further comprising at least one of:

(i) at least one open-loop control unit configured to perform open-loop control of the impact tool unit at least partially as a function of the spatial position of the impact tool unit; and (ii) at least one closed-loop control unit configured to perform closed-loop control of the impact tool unit at least partially as a function of the spatial position of the impact tool unit.

6. A blocking detection unit of a hand-held power tool device according to claim 1.

7. A hand-held power tool, comprising:

at least one hand-held power tool device, including:

an insertion tool;

an impact tool unit configured to drive the insertion tool at least partially in at least one of a rotational fashion and a translatory fashion;

an impact detection unit configured to detect at least one impact parameter, wherein the at least one impact parameter is a linear acceleration running at least substantially parallel to a processing axis of the insertion tool with respect to a housing of the at least one hand-held power tool device;

a blocking detection unit configured to detect at least one blocking parameter, wherein the at least one blocking parameter is an angular acceleration about the processing axis of the insertion tool with respect to the housing of the at least one hand-held power tool device;

a sensor element configured to detect both the linear acceleration and the angular acceleration; and a control unit that performs open-loop or closed-loop control of the impact tool unit as a function of the linear acceleration and the angular acceleration detected by the sensor element.

8. An impact detection unit of a hand-held power tool device comprising:

(i) an insertion tool, (ii) an impact tool unit configured to drive the insertion tool at least partially in at least one of a rotational fashion and a translatory fashion, and (iii) a blocking detection unit configured to detect at least one blocking parameter, wherein:

the impact detection unit is configured to detect at least one impact parameter;

the at least one impact parameter is a linear acceleration running at least substantially parallel to a processing axis of the insertion tool with respect to a housing of the at least one hand-held power tool device;

the at least one blocking parameter is an angular acceleration about the processing axis of the insertion tool with respect to the housing of the at least one hand-held power tool device; and wherein a sensor element is configured to detect both the linear acceleration and the angular acceleration.

* * * * *